United States Patent [19]

Barna

[11] 4,164,058

[45] Aug. 14, 1979

[54] DECORATIVE RING-LIKE STRUCTURE AND METHOD OF MAKING SAME

[76] Inventor: Ivan J. Barna, 4186 Colony, South Euclid, Ohio 44121

[21] Appl. No.: 874,808

[22] Filed: Feb. 3, 1978

[51] Int. Cl.[2] ..... A44B 21/00

[52] U.S. Cl. ..... 24/1; 24/243 R; 428/10; 24/256

[58] Field of Search ..... 24/1, 256; 16/127; 132/39, 46; 428/10

[56] References Cited

U.S. PATENT DOCUMENTS

| | | | |
|---|---|---|---|
| 345,164 | 7/1886 | Monroe | 24/1 |
| 385,995 | 7/1888 | Bowling | 24/1 |
| 659,937 | 10/1900 | Olden | 428/10 |
| 976,510 | 11/1910 | Siegel | 24/1 |
| 1,518,618 | 12/1924 | Waters | 428/10 |
| 2,076,945 | 4/1937 | Hoeflich | 428/10 |
| 2,186,574 | 1/1940 | Chadirjian | 24/163 FC |
| 2,424,740 | 7/1947 | Chamberlain | 24/256 |
| 2,857,601 | 10/1958 | Goldman | 24/256 |

*Primary Examiner*—Bernard A. Gelak
*Attorney, Agent, or Firm*—Fay & Sharpe

[57] ABSTRACT

A decorative ring-like structure includes a generally longitudinally split cylindrical sleeve having a fabric tube snuggly received thereover. The fabric tube has a length substantially greater than the circumference of the sleeve to provide a decorative pleated arrangement.

12 Claims, 12 Drawing Figures

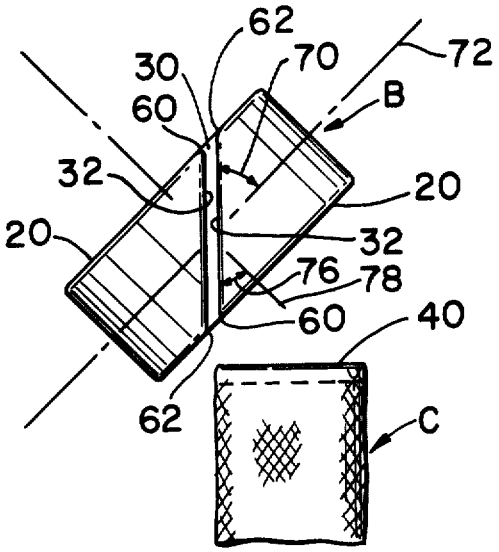
FIG. 7
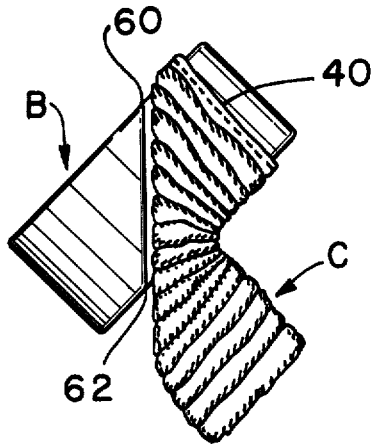
FIG. 8
FIG. 9
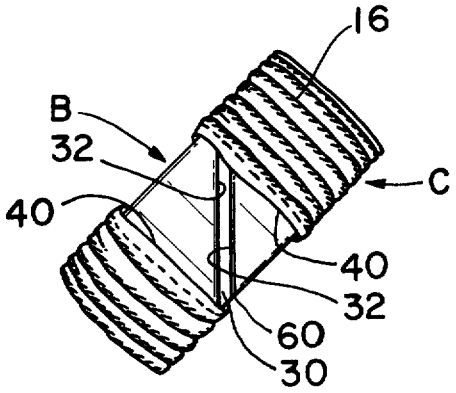
FIG. 10
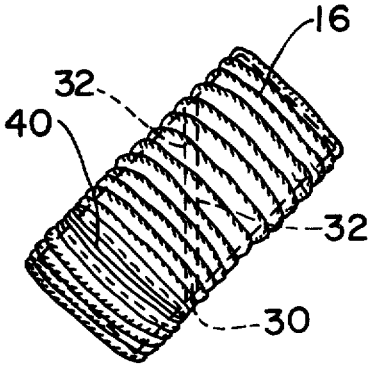
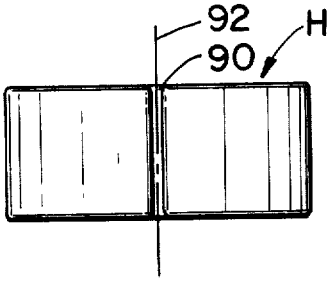
FIG. 11
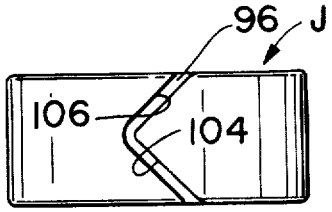
FIG. 12

DECORATIVE RING-LIKE STRUCTURE AND METHOD OF MAKING SAME

BACKGROUND OF THE INVENTION

This development relates to the art of decorative ring-like structures and, more particularly, to decorative napkin rings. Although the development specifically relates to napkin rings and will be described with reference thereto, it will be appreciated that the overall concepts involved may be used for other purposes and environments in which ring-like or generally encircling structures are used.

For formal dining, it is common to place napkins within relatively small rings at each place setting on a table. Such rings are normally of wood, metal or plastic, and do not provide a highly pleasing decorative appearance. Furthermore, such rings are relatively difficult to keep clean or clean-looking. While some prior napkin ring designs have included an outer decorative covering for matching a particular table setting or set of napkins, such coverings were affixed to the rings in a manner making it impossible to change the decorative appearance thereof for matching a different table setting or set of napkins.

SUMMARY OF THE INVENTION

A ring-like structure includes a generally cylindrical sleeve of substantially rigid plastic material. This sleeve is generally longitudinally split to define a circumferential space between opposed circumferential sleeve ends. A fabric tube is closely received over the sleeve and has a length substantially greater than the circumference of the sleeve.

The sleeve has a longitudinal axis and a length parallel to such axis which is substantially greater than its wall thickness radially of said axis. The sleeve is generally smoothly curved between all intersecting surfaces so as to be characterized by the absence of relatively sharp edges.

In a preferred arrangement, the cylindrical sleeve has a longitudinal axis and the fabric tube is snugly received on the sleeve such that it may be under at least some slight tension parallel to the longitudinal axis.

The fabric tube preferably has a length of at least two times the circumference of the sleeve and the tube is circumferentially pleated on the sleeve to provide a highly decorative arrangement.

The generally longitudinal split in the sleeve may be such that the circumferential space between the circumferential sleeve ends intersects the opposite longitudinal ends of the sleeve at circumferentially-spaced locations. This hides the split beneath the fabric tube because the tube cannot pull down into the split.

The circumferential space between the circumferential ends may extend in a straight line between the opposite longitudinal ends of the sleeve and may have a substantially uniform width along its entire line.

Instead of being knitted or woven as a seamless tube, the fabric tube includes a longitudinal seam which is located on the inside of the sleeve so that the outer surface of the ring does not contain any seams.

The fabric tube is substantially uniformly bunched around the sleeve in substantially uniform circumferential pleats. The tube is a snug enough fit on the sleeve to maintain these substantially uniform circumferential pleats. The fabric tube has tube ends which are squeezed together so they substantially disappear within the pleats of the fabric tube. The fabric tube ends are also circumferentially-spaced from the intersection of the circumferential space with the opposite longitudinal ends of the sleeve so that the tube ends will not pull down into the circumferential space at the split.

The circumferential space at the generally longitudinal split has a width which is at least three times the thickness of the fabric tube but not more than 10 times the thickness of the fabric tube. This makes it very easy to slide the fabric tube onto the sleeve by passing it through the split. At the same time, the width of the split is minimized so it will not be apparent in the finished ring-like structure.

The sleeve preferably has a longitudinal length parallel to its longitudinal axis which is substantially less than its internal and external diameters. Also, the sleeve preferably has a radial wall thickness substantially less than its longitudinal length.

The improved ring-like structure of the present invention is made by providing a generally longitudinally split rigid plastic sleeve having opposed circumferential ends. A fabric tube is provided having a length substantially greater than the circumference of the rigid sleeve and an internal size such as to be a snug or relatively tight fit on the sleeve. The assembly procedure includes the step of sliding one end of the fabric tube over one of the circumferential ends of the sleeve. The tube is then pushed completely onto the sleeve over the one circumferential end thereof by bunching the tube up on the sleeve. The fabric tube is then rearranged on the sleeve by squeezing the ends of the fabric tube together and substantially uniformly pleating the tube around the sleeve.

The tube used has a longitudinal seam and the tube is slid over the one circumferential end by positioning the seam on the inside of the sleeve.

One of the fabric tube ends is moved circumferentially over the generally longitudinal split in the sleeve after the tube is completely received on the sleeve. Therefore, the ends of the fabric tube are circumferentially-spaced from the longitudinal split in the finished napkin ring.

It is a principal object of the present invention to provide an improved ring-like structure and method of making same.

It is also an object of the invention to provide a ring-like structure which is very economical to manufacture and assemble.

It is a further object of the invention to provide an improved ring-like structure having a highly decorative appearance.

It is an additional object of the invention to provide a ring-like structure whose appearance can be changed if desired by simply changing a decorative covering therefor.

It is a further object of the invention to provide an improved ring-like structure which may be entirely placed in a washing machine for cleaning or which allows the fabric tube to be removed from the sleeve for such washing if so desired.

Other objects and advantages of the invention will become apparent to those skilled in the art upon a reading and understanding of the specification and drawings.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIG. 7 is a somewhat diagrammatic illustration showing the first step in assembling the fabric tube of FIG. 4 onto the sleeve of FIG. 3;

FIG. 8 is a diagrammatic illustration of a further assembly step;

FIG. 9 is a diagrammatic illustration of a further assembly step;

FIG. 10 is an illustration of a completed napkin ring following the assembly steps of FIGS. 7-9;

FIG. 11 is a side elevational view of another form of sleeve; and,

FIG. 12 is a side elevational view of still another form of sleeve.

DESCRIPTION OF A PREFERRED EMBODIMENT

Figure 1:
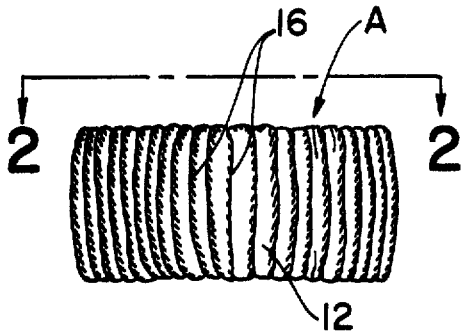
FIG. 1 is a side elevational view of a napkin ring constructed in accordance with the present invention.
Figure 2:
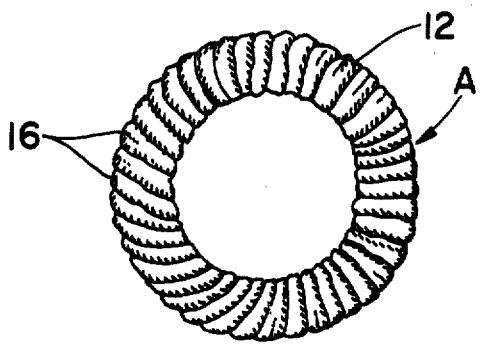
FIG. 2 is a plan view taken generally on line 2—2 of FIG. 1.

With reference to the drawings, FIGS. 1 and 2 show a generally cylindrical napkin ring A which includes an outer fabric covering 12 having circumferentially-spaced longitudinal pleats generally indicated at 16. Again, the concepts of the present development may be advantageously used for structures other than the napkin ring arrangement disclosed in detail hereinafter. Pleats 16 are substantially uniformly spaced circumferentially around the ring to provide a highly decorative and pleasing appearance.

Figure 3:
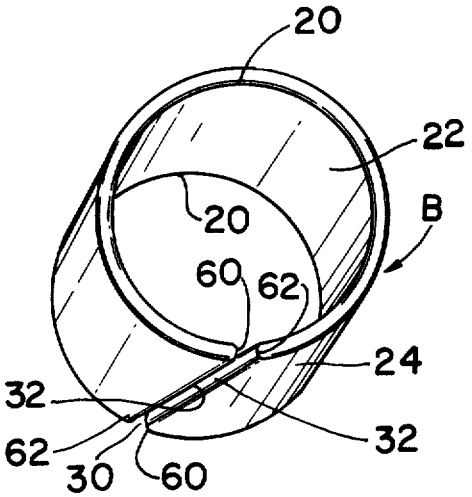
FIG. 3 is a perspective illustration of a rigid plastic sleeve used to make the napkin ring of FIGS. 1 and 2.

FIG. 3 shows a generally cylindrical sleeve B of substantially rigid synthetic plastic material. Any suitable rigid plastic material may be used to make sleeve B including, but not limited to, polyamide and polyvinylchloride. However, a high impact polystyrene is preferred since the overall inherent physical properties thereof allow the sleeve to simply be deposited in a washing machine with covering 12 thereon when cleaning is necessary and/or desired. Sleeve B is preferably molded to the general shape as shown in FIG. 3. However, it will be recognized that it is possible to cut cylinders from a cylindrical pipe and form sleeve B. However, molding sleeve B in one step is deemed more efficient because it is possible to mold same with no sharp edges.

Sleeve B has opposite circular longitudinal ends or faces 20, and includes inner surface 22 and an outer surface 24. The intersections of surfaces 22,24 with ends 20 are smoothly rounded so there are no sharp edges on the ring. Although inner and outer surfaces 22,24 are substantially plain and cylindrical, it will be recognized that at least surface 24 could be outwardly concave somewhat if so desired for providing a rounded appearance.

Sleeve B is longitudinally split to define a generally circumferential space 30 between opposed circumferential sleeve ends 32. The intersections of inner and outer surfaces 22,24 with circumferential sleeve ends 32 are smoothly rounded, as are the intersections of longitudinal ends 20 with circumferential ends 32. Thus, sleeve B is characterized by the absence of any sharp edges because all intersecting surfaces are smoothly rounded. The longitudinal split defining circumferential space 30 does not extend axially of sleeve B so that the intersections of space 30 with longitudinal ends 20 are circumferentially-spaced from one another a substantial distance.

In one arrangement, the generally longitudinal split extends at an included angle of approximately 30° to the longitudinal axis of sleeve B. However, it will be appreciated that this particular angle is not critical and the generally longitudinal split may be of many different angles and shapes. The important consideration is that there be no perfectly longitudinal space where the fabric covering for the sleeve can form a depression or interruption as will be appreciated hereinafter.

In the arrangement shown in FIG. 3, circumferential space 30 has a substantially uniform width along its entire length between opposite longitudinal ends 20 and is completely straight along its entire length. However, it will be appreciated that the generally longitudinal split can take the form and can be irregular or curved if so desired. It is preferred that a perfectly straight longitudinal line extending between opposite longitudinal ends 20 will cross space 30 over an axial length which is substantially less than the longitudinal length of sleeve B parallel to its longitudinal axis.

It will be appreciated that the precise dimensions of sleeve B form no part of the present invention and examples of such dimensions will be given simply for purposes of illustration only. In one arrangement, sleeve B has an axial length parallel to its longitudinal axis of approximately 15/16". Sleeve B has an external diameter of approximately 2". The radial thickness of the wall of sleeve B is approximately 3/16". However, it will be appreciated that the wall can vary in thickness between longitudinal ends 20. Thus, sleeve B has a length parallel to its longitudinal axis which is substantially less than its mean diameter. Likewise, the mean radial thickness of the wall is substantially less than the sleeve length.

Figure 4:
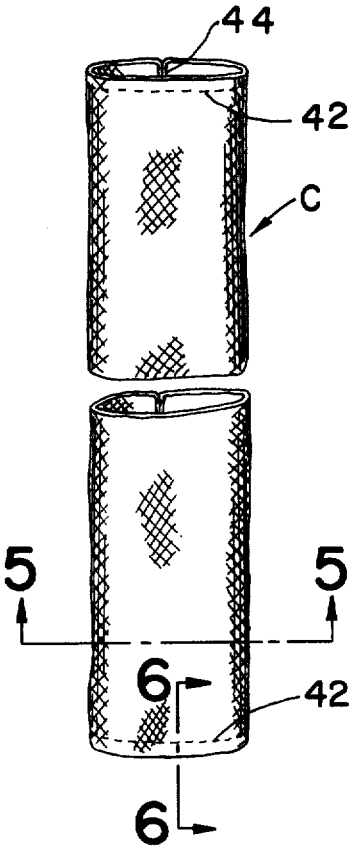
FIG. 4 is a plan view of an elongated fabric tube used to cover the sleeve of FIG. 3 in making the napkin ring of FIGS. 1 and 2.
Figure 5:
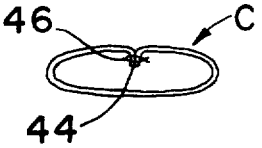
FIG. 5 is a cross-sectional elevational view taken generally on lines 5—5 of FIG. 4.
Figure 6:
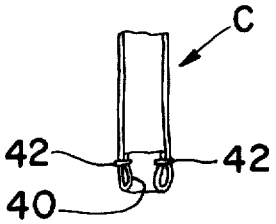
FIG. 6 is a partial cross-sectional elevational view taken generally on lines 6—6 of FIG. 4.

FIG. 4-6 show an elongated woven fabric tube C which may be of any desired color or have any desired decorative design thereon. The tube may be of any suitable woven fabric including, but not limited to, nylon or polyester. Tube C is made by taking a flat rectangular piece of fabric and folding end edges 40 over inwardly as best shown in FIG. 6 and then stitching them as at 42. The tube also has a longitudinal seam indicated generally at 44 in FIG. 5 which is provided by overlapping the adjacent longitudinal edges of the rectangular piece of fabric and stitching the same as at 46. To stitch longitudinal seam 46, the tube is folded inside out and must, therefore, be subsequently turned right side out for use in assembling the napkin ring.

Fabric tube C has a longitudinal length substantially greater than the mean circumference of sleeve B and preferably, has a length which is at least two times the mean circumference of sleeve B. The internal size of fabric tube C is such that it is quite a snug or tight fit on the sleeve when it is placed thereon. That is, the longitudinal length of sleeve B in a direction parallel to its axis is such that fabric tube C is placed under some degree of tension parallel to the longitudinal axis of sleeve B when it is positioned on the sleeve. The degree of snugness or amount of tension involved will vary depending upon the particular material utilized for tube C since different fabric materials have different stretch and strength characteristics. With a sleeve B having dimensions as previously given, fabric tube C has a transverse peripheral dimension of approximately 2 5/16". The length of the tube will vary and depends upon such factors as the type of fabric material used. With a sleeve dimensioned as previously explained, fabric tube C would have a length of between 16" and 22". The tube is made from a rectangular piece of fabric material approximately 2 13/16" wide by 16"-22" long. Seam 44 uses up ¼" of each opposite side edge or a total of ½". Each end seam 40 takes up approximately ¼". Since the ends of seam 44 will extend longitudinally along the inside of the fabric tube, these ends will take up some area between the sleeve surface and the tube. This then aids in providing the above noted generally snug fit between the sleeve and fabric tube.

The circumferential width of circumferential space 30 is at least three times but less than 10 times the thickness of the material from which fabric tube C is made for ease of assemblying the fabric tube on the sleeve. This relationship also prevents the fabric tube from pulling into space 30 after the tube has been placed on the sleeve as will be more fully appreciated hereinafter.

The generally longitudinal split in sleeve B is preferably such that each circumferential end 32 thereof intersects one longitudinal end or face 20 at a relatively sharp point 60 defining an acute included angle and intersects the opposite longitudinal end or face 20 at a relatively smoothly curved intersection 62 defining an obtuse included angle.

The preferred method of assembling fabric tube C onto sleeve B is as shown in FIGS. 7-10. One end 40 of the fabric tube is telescoped over one sleeve circumferential end 32 by inserting relatively sharp point 60 into the tube. The tube is then pushed so it slides onto the sleeve in the manner shown in FIG. 8. When the fabric tube is initially started on the sleeve, longitudinal seam 44 (FIG. 5) is preferably located on the interior of the sleeve. Sleeve B is then held on one side of circumferential space 30 while continuing to push fabric tube C onto sleeve B on the other side of circumferential space 30.

Eventually, the entire fabric tube is bunched up on sleeve B with the opposite ends 40 thereof circumferentially-spaced from the sleeve circumferential space 30 as generally shown in FIG. 9. One end 40 of the fabric tube is then moved circumferentially completely past circumferential space 30 so that the opposite ends 40 thereof are squeezed together in a location generally circumferentially-spaced from space 30 in sleeve B. The bunched tube is then uniformly pleated by shifting it relative to sleeve B as may be necessary until the circumferentially-spaced longitudinal pleats 16 are spaced as desired. In addition, tube ends 40 are preferably circumferentially spaced from the circumferential ends of sleeve B. However, it will be appreciated that tube ends 40 can span circumferential space 30 in the sleeve if so desired because the shape of the sleeve space is such that the ends of the tube will not pull thereinto. Again, the relative dimensioning between tube C and sleeve B is such that the fit of the tube on the sleeve is sufficiently snug to prevent relaxing of the pleats and to retain the tube substantially uniformly pleated on the sleeve. The fabric tube and the pleats provide a relatively resilient and high frictional engagement with a napkin received through the ring when the ring is placed into use.

Fabric tube C is preferably left unsecured on sleeve B so that it can be conveniently removed as may be necessary and/or desirable in order to accommodate, for example, washing, cleaning or replacement with fabric tubes of different colors and designs. That is, tube C is advantageously not bonded to sleeve B or otherwise permanently secured thereto.

As shown in FIG. 7, space 30 is preferably such that angle 70 between one end 32 and sleeve transverse axis 72 is less than the angle 76 between that same end 32 and longitudinal sleeve axis 78. It is also possible to have angle 76 less than or equal to angle 70. However, assembly of tube C onto sleeve B is easier when angle 70 is substantially less than angle 76.

FIG. 11 shows another sleeve H having a slit 90 parallel to sleeve longitudinal axis 92.

FIG. 12 shows another sleeve J having a generally V-shaped slit 96.

The dimensions of sleeves H and J are generally the same as those given for sleeve B. Where costs of dies is high, the sleeve of FIG. 11 may be the most practical. Assembly of a fabric tube onto sleeves H and J is the same as explained with reference to FIGS. 7-10. All corners are smoothly curved so there are no sharp edges. In the arrangement of FIG. 12, fabric tube C is slid onto pointed end 104 instead of onto notched end 106. The dimensions of the fabric tube are generally the same as previously explained where used with sleeves H and J. The ends of the fabric tube are circumferentially-spaced from slit 90 of FIG. 11. With an arrangement as in FIG. 12, it is possible to leave the ends of the fabric tube extending over portions of the slit but displaced from the intersections of the slit with the end edges of the sleeve.

The invention has been described with reference to the preferred embodiment. Obviously, modifications and alterations will occur to others upon the reading and understanding of this specification. It is my intention to include all such modifications and alterations insofar as they come within the scope of the claims or the equivalents thereof.

Having thus described my invention, I now claim:

1. A ring-like structure comprising: a generally cylindrical sleeve of substantially rigid plastic material, said sleeve being generally longitudinally split to define a circumferential space between spaced-apart non-overlapping opposed circumferential ends; a fabric tube internally sized for close reception over said sleeve and having a length between opposite tube ends which is greater than the circumference of said sleeve; said tube being closely received over said sleeve with said tube ends abutting; and, said circumferential space having a circumferential width greater than the thickness of the material forming said tube when said sleeve is in an unstressed condition, whereby said tube is positioned on said sleeve by telescoping one said tube end over one said sleeve end and then circumferentially sliding said tube onto said sleeve.

2. The ring-like structure as defined in claim 1 wherein said sleeve has a longitudinal axis and a length parallel to said axis which is substantially greater than its wall thickness radially of said axis, said sleeve being smoothly curved between all intersecting surfaces so as to be characterized by the absence of relatively sharp edges.

3. The ring-like structure as defined in claim 1 wherein the internal size of said tube is such that said fabric tube is snuggly received over said sleeve and said circumferential width of said circumferential space is approximately between 3 and 10 times the thickness of the material forming said tube.

4. The ring-like structure as defined in claim 1 wherein said fabric tube has a length at least two times the circumference of said sleeve and said tube is circumferentially pleated on said sleeve.

5. The ring-like structure as defined in claim 1 wherein said sleeve has a longitudinal axis and is generally longitudinally split so that said circumferential space intersects the opposite longitudinal ends of said sleeve at circumferentially-spaced locations.

6. The ring-like structure as defined in claim 5 wherein said circumferential space extends in a straight line between said opposite longitudinal ends of said sleeve and has a substantially uniform width along its entire length.

7. The ring-like structure as defined in claim 1 wherein said fabric tube includes a longitudinal seam and said seam is located on the inside of said sleeve.

8. The ring-like structure as defined in claim 1 wherein said fabric tube has a length at least two times the circumference of said sleeve and is substantially uniformly bunched around said sleeve in substantially uniform circumferential pleats, said tube being a snug enough fit on said sleeve to maintain said substantially uniform circumferential pleats, said tube ends being squeezed together and circumferentially-spaced from the intersection of said circumferential space with the opposite longitudinal ends of said sleeve.

9. A napkin ring comprising: a generally cylindrical sleeve of substantially rigid plastic material, said sleeve being generally longitudinally split to define a circumferential space between opposed circumferential sleeve ends; and, a fabric tube having a length at least two times the circumference of said sleeve, said tube being tightly received on said sleeve and being substantially uniformly bunched therearound, said tube having tube ends which are squeezed together and circumferentially-spaced from the intersections of said circumferential space with the opposite longitudinal ends of said sleeve.

10. The napkin ring as defined in claim 9 wherein said circumferential space has a circumferential width substantially greater than the thickness of the fabric from which said tube is made.

11. The napkin ring as defined in claim 10 wherein said circumferential space has a width of at least three but not more than 10 times the thickness of the fabric from which said tube is made.

12. The napkin ring as defined in claim 9 wherein said sleeve has a longitudinal length substantially less than its internal and external diameters and a radial thickness substantially less than its longitudinal length.

* * * * *